US010657785B2

(12) United States Patent
Gimbel

(10) Patent No.: US 10,657,785 B2
(45) Date of Patent: May 19, 2020

(54) PROCESS AND DETECTOR SYSTEM FOR DETECTING A FLAME EVENT

(71) Applicant: Dräger Safety AG & Co. KGaA, Lübeck (DE)

(72) Inventor: Doreen Gimbel, Lübeck (DE)

(73) Assignee: DRÄGER SAFETY AG & CO. KGAA, Lübeck (DE)

( * ) Notice: Subject to any disclaimer, the term of this patent is extended or adjusted under 35 U.S.C. 154(b) by 0 days.

(21) Appl. No.: 16/162,704

(22) Filed: Oct. 17, 2018

(65) Prior Publication Data

US 2019/0114892 A1 Apr. 18, 2019

(30) Foreign Application Priority Data

Oct. 18, 2017 (DE) ..... 10 2017 009 680

(51) Int. Cl.
*G08B 17/12* (2006.01)
*G08B 29/18* (2006.01)

(52) U.S. Cl.
CPC ..... *G08B 17/125* (2013.01); *G08B 17/12* (2013.01); *G08B 29/188* (2013.01)

(58) Field of Classification Search
None
See application file for complete search history.

(56) References Cited

U.S. PATENT DOCUMENTS

| | | | | |
|---|---|---|---|---|
| 5,375,159 | A | 12/1994 | Williams | |
| 6,696,958 | B2 | 2/2004 | Anderson | |
| 7,002,478 | B2 * | 2/2006 | Moore | G08B 17/125 340/522 |
| 7,609,852 | B2 | 10/2009 | Chen | |
| 2002/0109096 | A1 * | 8/2002 | Carter | G08B 17/12 250/339.15 |
| 2011/0050902 | A1 | 3/2011 | Hanses et al. | |
| 2011/0304728 | A1 * | 12/2011 | Owrutsky | H04N 5/33 348/135 |

FOREIGN PATENT DOCUMENTS

| | | |
|---|---|---|
| DE | 10 2008 001 383 A1 | 10/2009 |
| DE | 10 2012 213 125 A1 | 1/2014 |

* cited by examiner

*Primary Examiner* — Thomas S McCormack
(74) *Attorney, Agent, or Firm* — McGlew and Tuttle, P.C.

(57) ABSTRACT

A process is provided for detecting a flame event (4) with a detector system (1). The detector system (1) has an analysis and control unit (8), a radiation detector (10) and at least one camera detector (20) and monitors a detection area (3) with the radiation detector (10) and the at least one camera detector (20) for the occurrence of flame events (4). A detector system (1) is provided for detecting a flame event (4). The detector system (1) includes a radiation detector (10) and at least one camera detector (20) for monitoring a detection area (3) for the occurrence of flame events (4).

20 Claims, 3 Drawing Sheets

PROCESS AND DETECTOR SYSTEM FOR DETECTING A FLAME EVENT

CROSS REFERENCE TO RELATED APPLICATIONS

This application claims the benefit of priority under 35 U.S.C. § 119 of German Application 10 2017 009 680.5, filed Oct. 18, 2017, the entire contents of which are incorporated herein by reference.

TECHNICAL FIELD

The present invention pertains to the process for detecting a flame event by means of a detector system, wherein the detector system has a radiation detector and at least one camera detector and monitors a detection area by means of the radiation detector and the at least one camera detector for the occurrence of flame events. Further, the present invention pertains to a detector system for detecting a flame event, having a radiation detector and at least one camera detector for monitoring a detection area for the occurrence of flame events.

BACKGROUND

It is known, in principle, to provide recognition or detection of flame events in modern technology, for example, in industrial production plants. After such a detection of a flame event, an alarm may possibly be generated. The presence of corresponding detector systems in defined areas is sometimes even required by law.

For example, radiation detectors, which especially monitor the surrounding area of the radiation detector for the occurrence of a radiation signature that is characteristic of flame events, especially preferably in the infrared spectral range, may be used for the detection of flame events. Flame events can be detected very rapidly, often within 300 msec or faster, and, in addition, with a low error rate in most cases. Such a radiation detector is known, for example, from U.S. Pat. No. 5,375,159 (the entire contents of U.S. Pat. No. 5,375,159 are incorporated herein by reference). However, a drawback in such radiation detectors is that they are only configured for the global monitoring of a detection area, so that a flame event is detected as soon as such a flame event occurs in the detection area of the radiation detector. Radiation detectors thus cannot be used or can be used at least only on a limited basis, in areas, in which planned flame events, for example, torching and/or flares, are provided.

Further known detectors for the detection of flame events are camera detectors, which record sequences of images, for example, in the visual and/or infrared spectral range. As soon as an indication of a flame event is recognized in one of the images, these sequences of images can be subjected to a downstream image analysis, in which a flame event can be recognized reliably and with low error rate especially by means of an image-by-image analysis. This precise image analysis is often time-consuming, so that, especially in comparison to radiation detectors, camera detectors can provide a reliable detection of a flame event only after a certain time, often several seconds. In addition to this drawback of a slow detection rate, camera detectors have, however, the advantage that in the images recorded by the camera detectors, areas can be excluded from the image analysis and thus from the monitoring for flame events. Such flame cameras are, known, for example, from U.S. Pat. No. 6,696,958 as well as U.S. Pat. No. 7,609,852 (the entire contents of U.S. Pat. No. 6,696,958 as well as U.S. Pat. No. 7,609,852 are incorporated herein by reference).

SUMMARY OF THE INVENTION

On the basis of this state of the art, a basic object of the present invention is to eliminate these drawbacks from processes as well as detection systems for the detection of flame events. The object of the present invention is therefore to provide a process as well as a detector system for the detection of a flame event, which make it possible in an especially simple and cost-effective manner to make possible a rapid and as error-free as possible detection of flame events in areas, in which intended and planned flame events are also expected.

The above object is accomplished by a process for the detection of a flame event by means of a process using a detector system having the features according to the invention. Further, the object is accomplished by the detector system for the detection of a flame event according to the invention.

According to a first aspect of the present invention, the object is accomplished by a process for the detection of a flame event by means of a detector system, wherein the detector system has a radiation detector and at least one camera detector and monitors a detection area by means of the radiation detector and the at least one camera detector for the occurrence of flame events. The process according to the present invention is characterized by the following steps:

a) Specification of at least one exclusion area in the detection area of the detector system,
b) analysis of the radiation detector for the recognition of a radiation event,
c) in case of the presence of a radiation event recognized in step b), carrying out of a first analysis of the at least one camera detector for the recognition of a camera indication,
d) in case of the presence of a camera indication recognized in step c), carrying out of a check to determine whether the camera indication is located outside of the at least one exclusion area specified in step a), and
e) in case of the presence of a positive result of the check in step d), detection of a flame event in the detection area outside of the at least one exclusion area.

The process according to the present invention is provided for the detection of a flame event. A detector system is used during the process according to the present invention, wherein the detector system comprises an analysis and control unit, at least one radiation detector and at least one camera detector. A detection area of the detector system is monitored by means of the radiation detector and the at least one camera detector during the carrying out of the process according to the present invention to detect the occurrence of flame events. In the sense of the present invention, the detection area of the detector system is formed by the overlap of the detection areas of the detectors used. An additional analysis of the measured data of the individual detectors, which measured data are determined outside of this overlapping area, is possible. The radiation detector can preferably be configured to recognize a specific radiation signature, for example, a wavelength band, of such a flame event. The at least one camera detector is, in turn, preferably configured to record image data of the detection area and can provide at least one indication of the presence of a flame event in the detection area in the image data by means of a first analysis.

At least one exclusion area is specified in the detection area of the detector system in a first step a) of the process according to the present invention. This exclusion area is preferably specified such that it overlaps an area in the detection area, which shall not be monitored by the detector system. These may preferably be, for example, such areas, in which planned flame events, for example, torching, are intended and may also occur during the carrying out of the process according to the present invention or during the operation of a corresponding detector system. It can thus be made possible by such exclusion areas that the process according to the present invention may also be used where precisely such planned and intended flame events are carried out, without these flame events being recognized as especially unintended flame events. The entire detection area may especially also be specified as the exclusion area.

The radiation detector is analyzed in order to recognize the presence of a radiation event in the next step b) of the process according to the present invention. Such a radiation event may preferably be caused by the occurrence of a flame event in the detection area, for example, as a characteristic radiation signature of such a flame event recognized by the radiation detector. This can be made possible by means of radiation detectors in most cases rapidly and with a low error rate. After carrying out step b), information is thus available about whether a flame event, which has been recognized by means of the radiation detector as a radiation event, could be present in the detection area.

If such a radiation event has been recognized in step b), a first analysis of the at least one camera detector is carried out in the next step c). A camera indication may especially be recognized as a result of this first analysis of the at least one camera detector. A camera indication is especially a result of the first analysis, in which indications of a flame event are recognized in the detection area in at least one of the images recorded by the camera detector. In case of the operation of a camera detector as the sole detector, a second analysis, especially an image-by-image analysis, of the measurements of the camera detector could be carried out subsequent to the recognition of such a chamber indication in order to reliably detect the flame event and especially in order to rule out misidentifications. Such an image-by-image analysis preferably comprises a time series analysis, by means of which a course over time of image elements, especially of image elements, on which the camera indication is based, can be followed and assessed. Thus, in summary, a camera indication is present in case of an actually existing flame event after carrying out step c) in addition to the radiation event recognized in step b), so that, in other words, at least one indication of an existing flame event is present in the detection area of both detectors, both the radiation detector and the at least one camera detector.

In the next step d), in case of the presence of a camera indication recognized in step c), it is now checked whether this camera indication is located outside of the at least one exclusion area specified in step a). This represents a step of the process according to the present invention that is essential to the present invention because it is checked especially in this step whether the possible presence of the flame event indicated by the camera indication is located at a position, which shall be excluded from the monitoring due to the specification of the exclusion area. As a result, it can especially be made possible to distinguish between planned flame events, which are preferably located in areas of the detection area, which are covered by the at least one exclusion area, and unintended, possibly harmful flame events outside of this at least one exclusion area. Possible intended flame events, for example, torching, can be carried out in this manner, and can again be excluded from detection due to the specification of the exclusion area in step d), without detection of unintended, possibly harmful flame events being compromised thereby.

A flame event is finally detected in the last step e) of the process according to the present invention when the check in step d) has yielded a positive result. In particular, the flame event outside of the at least one exclusion area is detected in step e). In summary, the flame event is thus detected due to the presence both of a radiation event and of a camera indication, wherein especially the camera indication is located outside of the at least one exclusion area. In this way, the detection of flame events in the detection area can be carried out, wherein an exclusion area can, in turn, be excluded in the detection area. By using the radiation detector and only the first analysis of the at least one camera detector, the detection of the flame event can be provided by the process according to the present invention in an especially rapid manner and with low error rate. In addition, the process according to the present invention can be carried out by using two detectors in a detector system, for example, also by means of an especially compact detector system. Thus, the two detectors may also be arranged, for example, in a common housing. Also, no flame event is detected, in particular, when, for example, already no radiation event is recognized in step b), no camera indication is recognized in step c) and/or the camera indication is located within the specified at least one exclusion area in step d).

Further, the process according to the present invention may be further perfected to the effect that in the absence of a radiation event recognized in step b), the following steps are carried out:

f) Carrying out of a first analysis of the at least one camera detector for recognition of a camera indication, g) in case of the presence of a camera indication recognized in step f), carrying out of a second analysis of the at least one camera detector for recognition of a camera event, h) in case of the presence of a camera event recognized in step g), carrying out of a check whether the camera event is located outside of the at least one exclusion area specified in step a), and I) in case of the presence of a positive result of the check in step h), detection of a flame event in the detection area outside of the at least one exclusion area.

In this especially preferred further perfection of the process according to the present invention, it is taken into consideration that the radiation detector may also have a certain error rate, especially in regard to flame events which are not recognized in the radiation detector as a radiation event. Thus, a first analysis of the at least one camera detector is carried out for the recognition of a camera indication in step f) of this embodiment of the process according to the present invention even in the absence of a recognized radiation event. Should such a camera indication be recognized, a second analysis of the at least one camera detector is carried out in the next step g). This second analysis may comprise, for example, an image analysis, and preferably an image-by-image analysis, of a plurality of images of the detection area recorded by means of the at least one camera detector. In this second analysis, a camera event may be recognized, which likewise indicates the presence of a flame event in the detection area. In order to take into consideration possible intended flame events, which shall be excluded by means of specifying the exclusion area in step a), it is checked in the next step h), in turn, in case of the presence of a recognized camera event, whether the camera event is located outside of the specific exclusion area. Should this not be the case, the detection is stopped and no flame event is detected. However, should the recognized camera event be located outside of the specified exclusion area, a flame event is recognized in the final step I). This flame event is, in turn, located outside of the specified exclusion area. In this way, in this especially preferred embodiment of the process according to the present invention, provisions can be made for an even better detection of flame events outside of the exclusion area to be made possible, wherein especially reduction in the total error rate can be made possible due to exclusion of non-recognized flame events by means of the radiation detector.

In the process according to the present invention, provisions may further especially preferably be made for an alarm signal to be sent in case of a detection of a flame event in step e) and/or in step I). In this way, an alarm generation can be made possible when the presence of a positive detection of a flame event is indicated by the process according to the present invention. The alarm signal can be then sent especially directly by the detector system, for example, as an optical and/or acoustic alarm signal. As an alternative or in addition, the alarm signal may also be passed on to a downstream alarm generation unit, for example, as an electrical and/or electronic signal. Downstream alarm generation units in the sense of the present invention may be, for example, control systems, but also rescue organizations, for example, a fire department or the like. Comprehensive information about the surrounding area, especially, for example, for the introduction of countermeasures against the flame event, may be made possible in this way.

In addition, provisions may be made in the process according to the present invention for steps b) through e) and/or steps b) as well as f) through I) to be carried out continuously or at least essentially continuously. An interruption-free or at least essentially interruption-free monitoring of the detection area for the appearance of flame events outside of the exclusion area may be provided in this way. Thus, especially the analysis of the radiation detector can be carried out in step b) and the carrying out of the first analysis and/or of the second analysis of the at least one camera detector in steps c), f) and g) may preferably also be performed simultaneously and likewise continuously or at least essentially continuously.

In addition, the process according to the present invention may be configured to the effect that an infrared detector is used as radiation detector. Infrared detectors are especially preferably radiation detectors, because flame events in most cases have markedly recognizable heat signatures and thus characteristic radiation signatures in the infrared range. Control measurements in other wavelength ranges may also be carried out with infrared detectors in order to improve the measuring accuracy of a radiation detector configured as an infrared detector. In addition, infrared detectors may also be configured to check time delays, for example, a flickering or a change in size, of the flame event. A measuring accuracy of the radiation detector configured as an infrared detector may thereby be further improved. As an alternative or in addition, other wavelength ranges may also be monitored by corresponding special configuration of the radiation detector, for example, in order to recognize flame events of hydrogen fires in an especially reliable manner.

The process according to the present invention may also be configured to the effect that a VIS flame camera (a visible spectral range flame camera) and/or an IR flame camera (an infrared spectral range flame camera) are used as camera detectors. These are especially preferred embodiments of a camera detector, wherein a VIS flame camera monitors the detection area in the visual spectral range and an IR flame camera monitors the detection area in the infrared spectral range. Flame cameras are especially configured to carry out a first analysis for rapidly providing a camera indication, i.e., a first indication that a flame event could be present. An image processing as second analysis, especially an image-by-image analysis, by means of which the actual presence of a flame event can be recognized with high accuracy, is carried out downstream of the camera indication. Flame cameras may thus, in other words, especially rapidly yield a first indication of a flame event, wherein an exact recognition of a flame event can be provided with low error rate due to downstream image processing.

Provisions may especially preferably be made in the process according to the present invention for at least two camera detectors to be used, wherein a camera indication located outside of the at least one exclusion area specified in step a) is recognized by at least one of the camera detectors for the detection of a flame event in step e), and/or a camera event located outside of the at least one exclusion area specified in step a) is recognized by at least one of the camera detectors for detection of a flame event in step h). At least two camera detectors, which can be used especially at the same time and/or independently of one another, are used in this embodiment of the process according to the present invention. Since a camera indication and/or a camera event has to be recognized only by one of the two camera detectors outside of the at least one exclusion area specified in step a) for the detection of a flame event, a further reduction of false alarms and/or non-detected flame events can be achieved. In other words, the two camera detectors can be used as redundant units. A flame event is detected as soon as at least one of the camera detectors recognizes a camera indication or a camera event.

The process according to the present invention may also be further perfected to the effect that two camera detectors are used, wherein a VIS flame camera is used as the first camera detector and an IR flame camera is used as the second camera detector. In this especially preferred embodiment, two different flame cameras are used as camera detectors. The two flame cameras are especially configured such that they monitor two different spectral bands, the visual spectral band and the infrared spectral band. A further improvement of the detection reliability of a flame event in the detection area can be provided in this way.

Provisions may further be made according to another further perfection of the process according to the present invention for steps c) through e) to be carried out first for the VIS flame camera, steps c) through e) being carried out for the IR flame camera in case of the absence of a camera indication of the VIS flame camera recognized in step c). In other words, in this preferred embodiment, the VIS flame camera is first analyzed for the recognition of a camera indication and the use of the IR flame camera is only carried out in case of the absence of a recognized camera indication by the VIS flame camera. In other words, after the recognized radiation event by the radiation detector, which preferably operates in the infrared range, the VIS flame camera is used for checking in order to include two different radiation ranges and spectral ranges as early as possible in the detection of the flame event during the carrying out of the process according to the present invention. Should no camera indication be recognized by the VIS flame camera, a possible erroneous overlooking of a flame event can be prevented or at least be made markedly difficult by means of the additional use of the IR flame camera.

As an alternative or in addition, the process according to the present invention may be further perfected to the effect that steps f) through g) are first carried out for the VIS flame camera, wherein steps f) through I) are carried out for the IR flame camera in case of a camera event recognized in step g) for the VIS flame camera. In this embodiment of the process according to the present invention, it is taken into consideration that the VIS flame camera in most cases has a higher error rate and thus a more frequent triggering of false alarms than an IR flame camera. In this embodiment of the process according to the present invention, checking of the VIS flame camera can therefore be carried out by the IR flame camera. The reliability in case of a recognized and detected flame event can thereby be increased. Step h) of the process according to the present invention, in which checking of the recognized camera event for a location within or outside of the exclusion area is carried out, may also be carried out separately for the VIS flame camera or, in addition, together with the IR flame camera in a single performance of step h).

In addition, the process according to the present invention may, as an alternative, be further perfected to the effect that steps f) through g) are only carried out for the VIS flame camera, wherein steps f), h) and I) are carried out for the IR flame camera in case of a camera event recognized in step g) for the VIS flame camera, wherein in the presence of a camera indication of the IR flame camera recognized in step f), a check is carried out in step h) whether the camera indication is located outside of the at least one exclusion area specified in step a). It is also taken into consideration in this embodiment of the process according to the present invention that the VIS flame camera in most cases has a higher error rate than an IR flame camera. Therefore, in this embodiment of the process according to the present invention, a checking of the VIS flame camera by the IR flame camera may also be carried out, wherein the measurements of the IR flame camera are only checked for the presence of a camera indication in this alternative embodiment. Reliability in case of a recognized and detected flame event can as a result be increased and at the same time the entire carrying out of the process according to the present invention can be accelerated due to dispensing with the carrying out of a second analysis of the IR flame camera.

Provisions may further be made according to a preferred further perfection of the process according to the present invention that a flame event is detected in step I) when a VIS location of the camera event of the VIS flame camera and an IR location of the camera event of the IR flame camera coincide or at least essentially coincide. In this way, it can be avoided that the two flame cameras recognize camera events, which are located at different positions. A flame event is recognized by the process according to the present invention in this embodiment only if both locations, both the VIS location and the IR location, coincide. A further reduction of the error rate and thereby avoiding and preventing false alarms due to falsely recognized flame events can be made possible in this way.

In addition, the process according to the present invention may be configured to the effect that step f) is carried out only for the VIS flame camera, wherein steps f) through I) are carried out for the IR flame camera in case of the absence of the camera indication of the VIS flame camera recognized in step f). In other words, indication of the presence of a flame event is generated in this embodiment of the process according to the present invention neither by the radiation detector nor by the VIS flame camera. Should a camera indication and a corresponding camera event, which lies outside of the exclusion area, nevertheless be detected by the IR flame camera, a flame event is by and large also recognized in this case. Also in case of an erroneous non-detection of the flame event by the radiation detector and the VIS flame camera, reliable detection of the flame event can thus be made possible by the process according to the present invention.

According to a second aspect of the present invention, the object is accomplished by a detector system for detecting a flame event, comprising an analysis and control unit, a radiation detector and at least one camera detector for monitoring a detection area for the occurrence of flame events. The detector system according to the present invention is characterized in that the detector system is configured to carry out the process according to the first aspect of the present invention. In this way, the detector system according to the present invention offers all the advantages that were mentioned in detail already in conjunction with the process according to the first aspect of the present invention.

In the detector system according to the present invention, provisions may especially preferably be made for the radiation detector and the at least one camera detector to be arranged in a common housing. In this way, an especially compact configuration of the detector system according to the present invention can be provided.

The detector system according to the present invention may also be further perfected to the effect that a radiation detection area of the radiation detector and a camera detection area of the at least one camera detector have a congruent or at least essentially congruent configuration. A detection area of the entire detector system especially results from the overlap of the radiation detection area of the radiation detector and the camera detection areas of the camera detectors used. Since the radiation detection area and the camera detection area have a congruent or at least essentially congruent configuration, an especially larger detection area of the entire detector system can be provided. Especially areas, which cannot be monitored by all the detectors used or even can be monitored by only a single one of the detectors used, can as a result be minimized or preferably even avoided entirely.

As described above, the detection area of the detector system in the sense of the present invention is especially formed by the overlap of the detection areas of the detectors used. An additional analysis of the measured data of the individual detectors, which are determined outside of this overlapping area, is possible. As an alternative to congruency, the radiation detection area may, for example, have a markedly larger configuration than the camera detection area, which may especially have a configuration adapted to the planned torching. In this case, the radiation detector is used for the actual monitoring for flame events, wherein the detector system according to the present invention or the process according to the present invention makes it possible to block out intended torching.

Further, in case of the detector system according to the present invention, provisions may especially preferably be made for the radiation detector to be configured as an infrared detector and/or the at least one camera detector to be configured as a VIS flame camera and/or as an IR flame camera. As already described above, these detectors represent especially preferred embodiments of a radiation detector and of a camera detector. In particular, the detector system may have both an infrared detector and a VIS flame camera and additionally an IR flame camera. An especially reliable detection of a flame event, which may especially be carried out especially rapidly, with a lower error rate can be made possible in this way.

Further actions improving the present invention appear from the following description of exemplary embodiments of the present invention, which are shown in the figures. All of the features and/or advantages appearing from the claims, the description and the drawings, including structural details and arrangements in space, may be essential to the present invention both in themselves and in the different combinations. Components with identical function and mode of action are provided with the same reference numbers in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
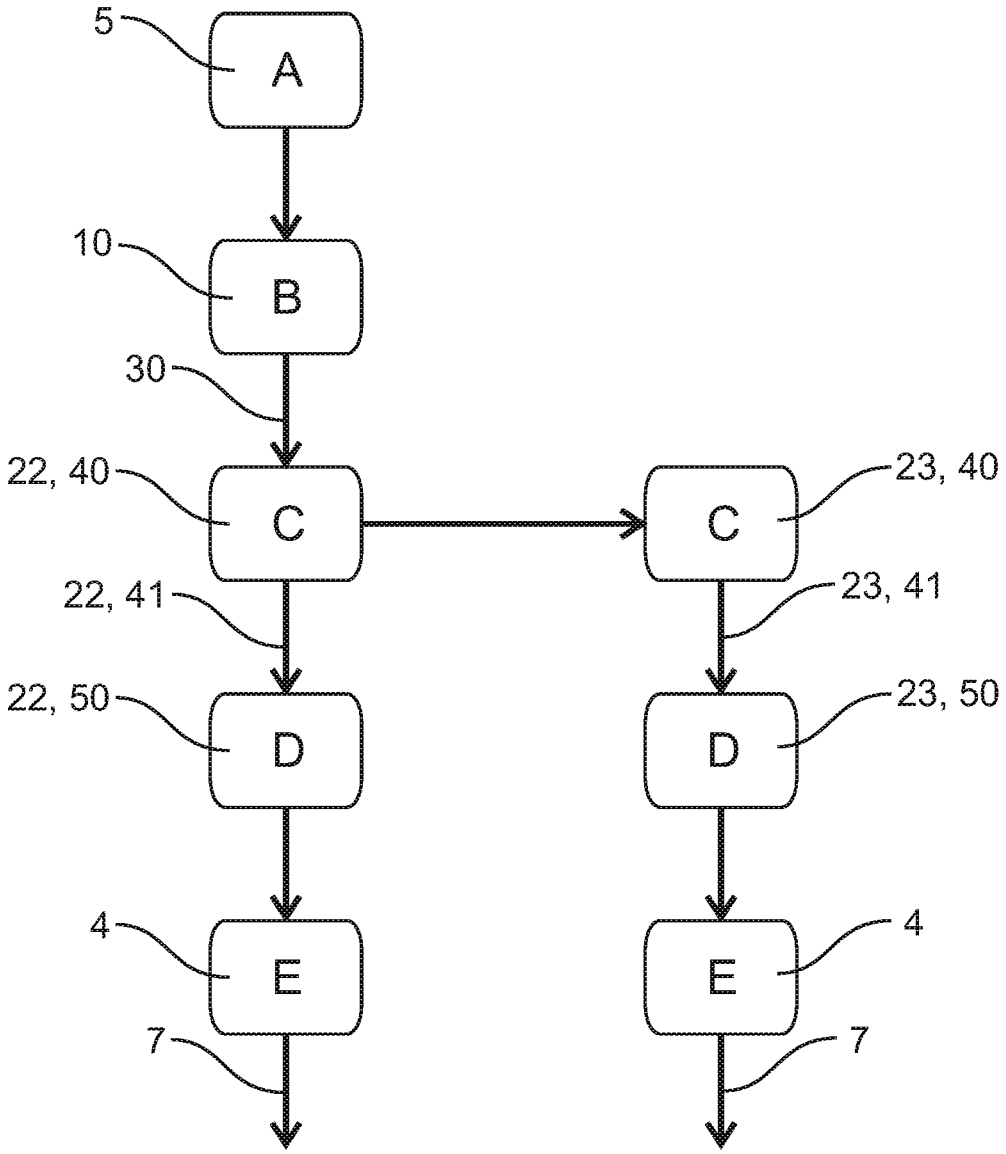
FIG. 1 is a flow diagram showing a first embodiment of the process according to the present invention.
Figure 2:
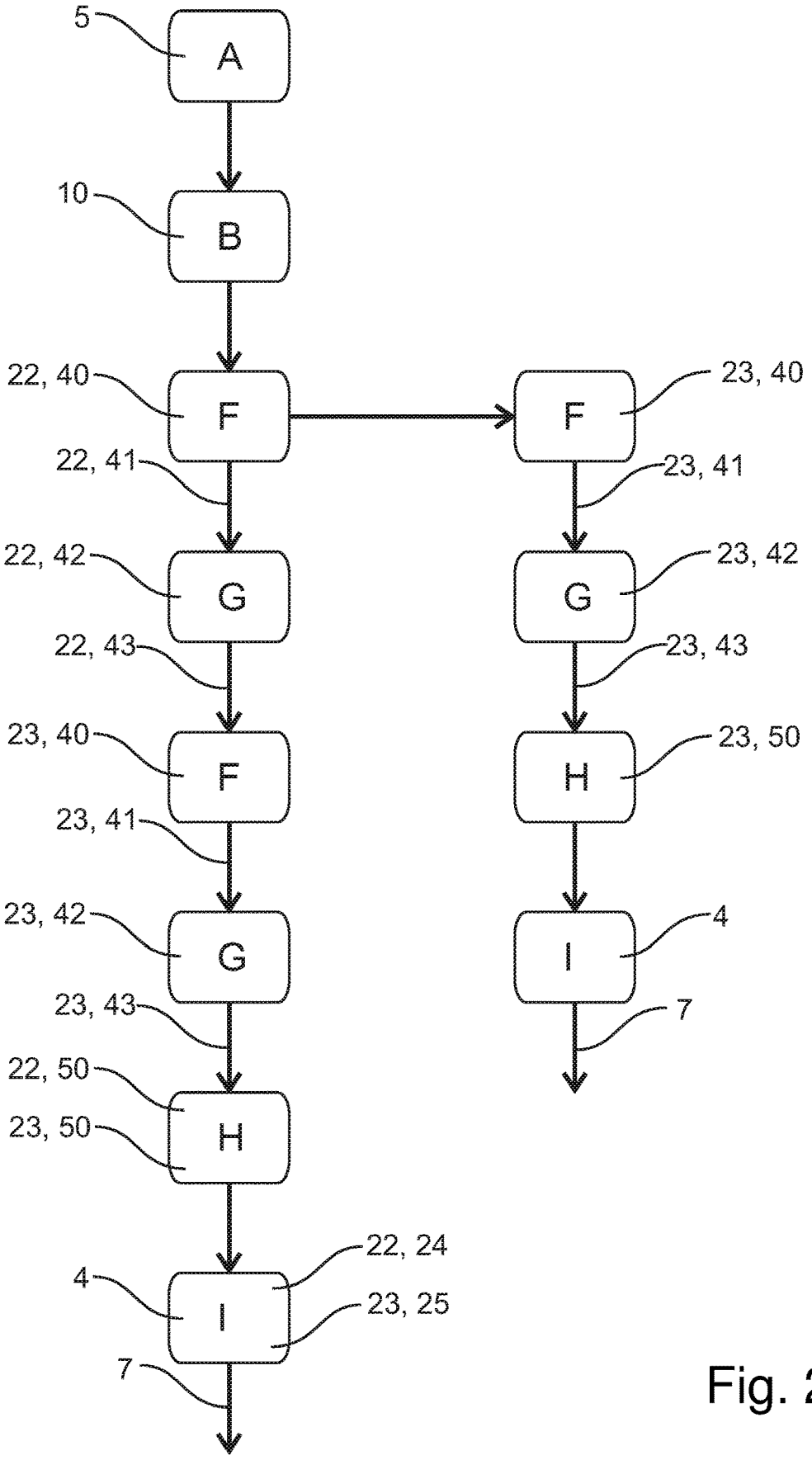
FIG. 2 is a flow diagram showing a second embodiment of the process according to the present invention.
Figure 3:
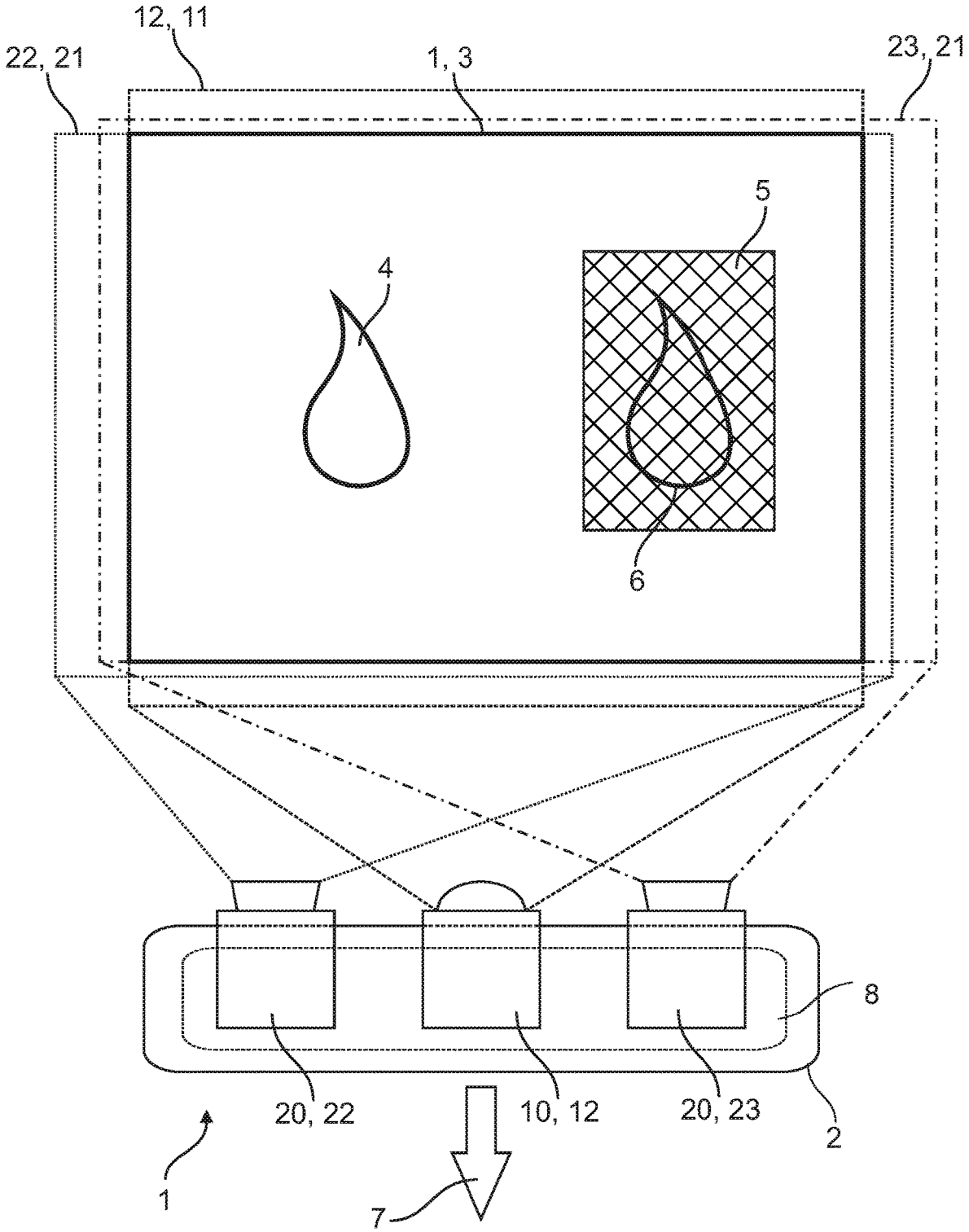
FIG. 3 is a schematic view showing the detector system according to the present invention.

Referring to the drawings, FIGS. 1 and 2 show possible embodiments of the process according to the present invention as they can be carried out by the detector system 1 according to the present invention. FIG. 3 shows a possible embodiment of the detector system 1 according to the present invention. FIGS. 1 through 3 are described jointly below, wherein the details of each of the individual figures are dealt with separately.

FIG. 3 shows the detector system 1 according to the present invention, which is configured to detect a flame event 4 in a detection area 3 of the detector system 1. The detector system 1 shown comprises an analysis and control unit 8 comprised of one or more processors, a radiation detector 10 and two camera detectors 20, which are arranged in a common housing 2 and are each connected to the analysis and control unit 8. An especially compact embodiment of the detector system 1 according to the present invention can be made possible in this way. The radiation detector 10 is especially configured as an infrared detector 12. The two camera detectors 20 are configured as a VIS flame camera 22 and as an IR flame camera 23. The detection area 3 of the detector system 1 is obtained from the overlap of the radiation detection area 11 of the radiation detector 10 as well as the camera detection areas 21 of the two camera detectors 20. The detection areas 11, 21 of the individual detector subsystems 10, 20 are identified in FIG. 3 with different dotted lines and preferably have, as shown, an at least essentially congruent configuration, up to small edge sections. Further, it can be seen in FIG. 3 that both a flame event 4 and a torching are located in the detection area 3 of the detector system 1.

A torching represents an intended and/or planned flame event, wherein in case of the occurrence of a torching 6, a flame event shall especially not be recognized by the detector system 1. This can be provided by an exclusion area 5 being specified in the detection area 3 in a first step a), designated by A in FIGS. 1 and 2, in each embodiment of the process according to the present invention. This exclusion area 5 is preferably specified such that possible torching 6 are entirely covered by this exclusion area 5.

The signal output of the radiation detector 10 is analyzed by the analysis and control unit 8 in the next step b), designated by B in FIGS. 1 and 2, in order to recognize a radiation event 30.

The possible embodiment of the process according to the present invention shown in FIG. 1 is further described below. In case of the presence of a radiation event 30 recognized in step b), a signal output of the camera detector 20 is analyzed by the analysis and control unit 8 in the next step c), designated by C in FIG. 1, in order to recognize a camera indication 41. In the process shown in FIG. 1, first the VIS flame camera 22 is subjected to the first analysis 40 in step c). Should a camera indication 41 be found in this first analysis 40, this camera indication 41 is subjected in the next step d), designated by D in the left-hand branch of the process shown in FIG. 1, to a check 50 by the analysis and control unit 8 whether the camera indication 41 recognized by the VIS flame camera is located within or outside of the exclusion area 5. Should the result of this check 50 turn out to be positive, i.e., the flame event 4 is recognized outside of the exclusion area 5, a flame event 4 is recognized in the next step e), designated by E in FIG. 1, in the detection area 3 outside of the at least one exclusion area 5. An alarm signal 7 may subsequently be sent by the analysis and control unit 8 based on this detection of the flame event 4.

Should no camera indication be recognized in step c) in the first analysis 40 of the VIS flame camera 22, then step c) is carried out by the analysis and control unit 8 for the IR flame camera 23, which is shown in the right-hand branch of the process shown in FIG. 1, and this IR flame camera 23 is likewise subjected to a first analysis 40. Should a camera indication 41 of the IR flame camera 23 be recognized in this first analysis 40, this camera indication 41 now provided by the IR flame camera 23 is checked again by the analysis and control unit 8 in the next step d) to determine whether this camera indication 41 is located within or outside of the exclusion area 5. Should the result of this check 50 be that the camera indication 41 is located outside of the exclusion area 5, the flame event 4 is, in turn, detected in the last step e) of the process according to the present invention. An alarm signal 7 may subsequently be sent by the analysis and control unit 8 based on this detection of the flame event 4.

The embodiment of the process according to the present invention shown in FIG. 2 pertains to the case when no radiation event 30 is recognized in step b) during the analysis of the radiation detector 10. In this case, a first analysis 40, for example, of the VIS flame camera 22, can nevertheless be carried out by the analysis and control unit 8 in the next step f), designated by F in FIG. 2. Should a camera indication 41 be recognized in this first analysis 40, then a second analysis 42 of the VIS flame camera 22 is carried out by the analysis and control unit 8 in the next step g), designated by G in FIG. 2, the left-hand branch of the embodiment of the process according to the present invention shown in FIG. 2. A camera event 43 of the VIS flame camera 22 may be recognized by the analysis and control unit 8 as a result of this second analysis 42. The second analysis 42 may preferably be, for example, a downstream image analysis, especially an image-by-image analysis. An especially reliable, even though time-consuming detection of a flame event 4 may be provided by this second analysis 42. In case of the presence of a camera event 43 of the VIS flame camera, steps f) and g) are repeated for the IR flame camera 23. As a result, reliability during the detection of the flame event 4 can be increased and misidentifications by the VIS flame camera 22 can especially be avoided. Should a camera indication 41 be recognized (step f) during the first analysis 40 of the IR flame camera 23, then a second analysis 42 may also be carried out by the analysis and control unit 8 for the IR flame camera 23 in step g). A camera event 43 of the IR flame camera 23 may, in turn, be obtained as a result of this second analysis 42 of the IR flame camera 23. As an alternative, a repetition only of step f) for the IR flame camera 23 is also possible for the recognition of a camera indication 41. The next step h), designated by H in FIG. 2, comprises, in turn, a check 50, in this embodiment, of the locations of the camera event 43 both of the VIS flame camera 22 and of the IR flame camera 23. In the alternative embodiment, the location of the camera indication of the IR flame camera is checked instead of the location of the camera event 43. Should the check 50 by the analysis and control unit 8 show for both flame cameras 22, 23 that the respective camera event 43 or the camera indication 41 lies outside the exclusion area, a flame event 4 is detected in the next step I), designated by I in FIG. 2. In step I), it can further be checked by the analysis and control unit 8 whether a VIS location 24 of the camera event 43 of the VIS flame camera 22 and an IR location of the IR flame camera 23 coincide. This coinciding may also be used as a condition that must be met for a detection of a flame event 4 in step I). Subsequent to the detection of the flame event 4, an alarm signal 7 may also be sent in this embodiment of the process according to the present invention.

Should no camera indication 41 be recognized in the first step f) carried out, in which a first analysis 40 of the VIS flame camera 22 is carried out, shown in the right-hand branch of the process according to the present invention in FIG. 2, steps f) through I) may also solely be carried out by the analysis and control unit 8 for the IR flame camera 23. A first analysis 40 of the IR flame camera 23 is then carried out in step f) in order to obtain a camera indication 41 of the IR flame camera 23. Should this camera indication 41 be present, a second analysis 42 of the IR flame camera 23 is carried out in step g) in order to obtain a camera event 43. In the next step h), the location of the camera event is checked by the analysis and control unit 8 to determine whether it lies outside of the exclusion area 5. Should this check 50 be positive, a flame event 4 outside of the exclusion area is recognized in step I) in the detection area of the detector system 1 and an alarm signal is subsequently sent.

In addition, all steps of the process according to the present invention, especially steps b) through e) as well as f) through I) may be carried out continuously or at least essentially continuously. In summary, an especially rapid and especially also reliable and accurate detection of a flame event 4 in a detection area 3 can be provided by means of the detector system 1 according to the present invention and by means of the process according to the present invention, wherein an exclusion area 5 can be defined in the detection area 3, which is excluded from the detection by the detector system 1. A rapid and at the same time reliable detection of flame events 4 in areas, in which, for example, torching 6 are intended, may be provided in this way.

While specific embodiments of the invention have been shown and described in detail to illustrate the application of the principles of the invention, it will be understood that the invention may be embodied otherwise without departing from such principles.

APPENDIX

| LIST OF REFERENCE NUMBERS | |
|---|---|
| 1 | Detector system |
| 2 | Housing |
| 3 | Detection area |
| 4 | Flame event |
| 5 | Exclusion area |
| 6 | Torching |
| 7 | Alarm signal |
| 8 | analysis and control unit |
| 10 | Radiation detector |
| 11 | Radiation detection area |
| 12 | Infrared detector |
| 20 | Camera detector |
| 21 | Camera detection area |
| 22 | VIS flame camera |
| 23 | IR flame camera |
| 24 | VIS location |
| 25 | IR location |
| 30 | Radiation event |
| 40 | First analysis |
| 41 | Camera indication |
| 42 | Second analysis |
| 43 | Camera event |
| 50 | Check |

What is claimed is:

1. A process for the detection of a flame event, the process comprising the steps of:

providing a detector system comprising analysis and control unit, a radiation detector and at least one camera detector, the detector system being configured to monitor a detection area with the radiation detector and the at least one camera detector for the occurrence of flame events;

specifying at least one exclusion area in the detection area of the detector system;

analyzing the radiation detector for a recognition of a radiation event;

upon the recognition of a radiation event, carrying out of a first analysis of the at least one camera detector for a recognition of a camera indication;

upon the recognition of a camera indication, carrying out a check via the analysis and control unit as to whether the camera indication is located outside of the at least one exclusion area; and upon the check indicating the camera indication is located outside of the at least one exclusion area, detecting a flame event in the detection area outside of the at least one exclusion area.

2. A process in accordance with claim 1, wherein with no radiation event recognized, the process further comprises the steps of:

carrying out of a first analysis of the at least one camera detector for the recognition of a camera indication;

in case of a presence of the camera indication carrying out of a second analysis of the at least one camera detector for a recognition of a camera event;

in case of a presence of a camera event, carrying out a check as to whether the camera event is located outside of the at least one exclusion area specified; and upon determining the camera event is located outside of the at least one exclusion area specified, detecting a flame event in the detection area outside of the at least one exclusion area.

3. A process in accordance with claim 1, wherein if a flame event is detected in step of detecting a flame event in the detection area outside of the at least one exclusion area an alarm signal is sent, the at least one exclusion area comprising a predetermined flame event.

4. A process in accordance with claim 1, wherein said steps of:

analyzing the radiation detector for a recognition of a radiation event;

upon the recognition of a radiation event, carrying out of a first analysis of the at least one camera detector for a recognition of a camera indication;

upon the recognition of a camera indication, carrying out a check as to whether the camera indication is located outside of the at least one exclusion area; and upon the check indicating the camera indication is located outside of the at least one exclusion area, detecting a flame event in the detection area outside of the at least one exclusion area are carried out continuously or at least essentially continuously.

5. A process in accordance with claim 1, wherein a VIS flame camera and/or an IR flame camera is used as the camera detector.

6. A process in accordance with claim 1, wherein:

at least two camera detectors are used; and a camera indication located outside of the at least one exclusion area specified is recognized by at least one of the camera detectors for detection of a flame event in the step of detecting a flame event in the detection area outside of the at least one exclusion area.

7. A process in accordance with claim 6, wherein a VIS flame camera is used as a first camera detector and an IR flame camera is used as a second camera detector.

8. A process in accordance with claim 7, wherein said steps:

upon the recognition of a radiation event, carrying out of a first analysis of the at least one camera detector for a recognition of a camera indication;

upon the recognition of a camera indication, carrying out a check as to whether the camera indication is located outside of the at least one exclusion area; and upon the check indicating the camera indication is located outside of the at least one exclusion area, detecting a flame event in the detection area outside of the at least one exclusion area are only carried out for the VIS flame camera; and in case of an absence of a camera indication of the VIS flame camera said steps:

upon the recognition of a radiation event, carrying out of a first analysis of the at least one camera detector for a recognition of a camera indication;

upon the recognition of a camera indication, carrying out a check as to whether the camera indication is located outside of the at least one exclusion area; and upon the check indicating the camera indication is located outside of the at least one exclusion area, detecting a flame event in the detection area outside of the at least one exclusion area are again carried out for the IR flame camera.

9. A process in accordance with claim 2, wherein:

two camera detectors are used with a VIS flame camera used as a first camera detector and an IR flame camera used as a second camera detector; and the steps of: carrying out of a first analysis of the at least one camera detector for the recognition of a camera indication; and in case of a presence of the camera indication carrying out of a second analysis of the at least one camera detector for a recognition of a camera event are only are only carried out for the VIS flame camera; and in case of recognition of a camera event for the VIS flame camera, the steps of: in case of a presence of a camera event, carrying out a check as to whether the camera event is located outside of the at least one exclusion area specified; and upon determining the camera event is located outside of the at least one exclusion area specified, detecting a flame event in the detection area outside of the at least one exclusion area are carried out for the IR flame camera.

10. A process in accordance with claim 2, wherein:

two camera detectors are used with a VIS flame camera used as a first camera detector and an IR flame camera used as a second camera detector;

the steps of: carrying out of a first analysis of the at least one camera detector for the recognition of a camera indication; and in case of a presence of the camera indication carrying out of a second analysis of the at least one camera detector for a recognition of a camera event;

in case of a presence of a camera event, carrying out a check as to whether the camera event is located outside of the at least one exclusion area specified; and upon determining the camera event is located outside of the at least one exclusion area specified, detecting a flame event in the detection area outside of the at least one exclusion area are only are only carried out for the VIS flame camera;

in case of recognition of a camera event for the VIS flame camera, the steps of: carrying out of a first analysis of the at least one camera detector for the recognition of a camera indication; in case of a presence of a camera event, carrying out a check as to whether the camera event is located outside of the at least one exclusion area specified; and upon determining the camera event is located outside of the at least one exclusion area specified, detecting a flame event in the detection area outside of the at least one exclusion area are carried out for the IR flame camera; and if a camera indication of the IR flame camera is recognized in the step of carrying out of a first analysis of the at least one camera detector for the recognition of a camera indication for the IR flame camera, a check is carried out as to whether the camera indication for the IR flame camera is located outside of the at least one exclusion area specified.

11. A process in accordance with claim 9, wherein the detection of a flame event is further based on a VIS location of the camera event of the VIS flame camera and an IR location of the camera indication and/or of the camera event of the IR flame camera coinciding or at least essentially coinciding.

12. A process in accordance with claim 2, wherein:

two camera detectors are used with a VIS flame camera used as a first camera detector and an IR flame camera used as a second camera detector;

the step of: carrying out of a first analysis of the at least one camera detector for the recognition of a camera indication is only carried out for the VIS flame camera;

in case of the absence of a camera indication of the VIS flame camera, the steps: carrying out of a first analysis of the at least one camera detector for the recognition of a camera indication; in case of a presence of the camera indication carrying out of a second analysis of the at least one camera detector for a recognition of a camera event; in case of a presence of a camera event, carrying out a check as to whether the camera event is located outside of the at least one exclusion area specified; and upon determining the camera event is located outside of the at least one exclusion area specified, detecting a flame event in the detection area outside of the at least one exclusion area, are carried out for the IR flame camera.

13. A detector system for detecting a flame event, the detector system comprising:

a radiation detector;

at least one camera detector for monitoring a detection area for the occurrence of flame events; and an analysis and control unit configured to:

specify at least one exclusion area in the detection area of the detector system;

analyze the radiation detector for a recognition of a radiation event;

upon the recognition of a radiation event, carry out of a first analysis of the at least one camera detector for a recognition of a camera indication;

upon the recognition of a camera indication, carry out a check as to whether the camera indication is located outside of the at least one exclusion area; and upon the check indicating the camera indication is located outside of the at least one exclusion area, detect a flame event in the detection area outside of the at least one exclusion area.

14. A detector system in accordance with claim 13, wherein the radiation detector and the at least one camera detector are arranged in a common housing, wherein two camera detectors are used with a VIS flame camera used as a first camera detector and an IR flame camera used as a second camera detector wherein with no radiation event recognized, the analysis and control unit being further configured to:

carry out a first analysis of the at least one camera detector for the recognition of a camera indication;

in case of a presence of the camera indication, carry out of a second analysis of the at least one camera detector for a recognition of a camera event;

in case of a presence of a camera event, carry out a check as to whether the camera event is located outside of the at least one exclusion area specified;

upon determining the camera event is located outside of the at least one exclusion area specified, detect a flame event in the detection area outside of the at least one exclusion area;

carrying out a first analysis of the at least one camera detector for the recognition of a camera indication;

in case of a presence of the camera indication carry out second analysis of the at least one camera detector for a recognition of a camera event are only are only carried out for the VIS flame camera;

in case of recognition of a camera event for the VIS flame camera, in case of a presence of a camera event, carry out a check as to whether the camera event is located outside of the at least one exclusion area specified; and upon determining the camera event is located outside of the at least one exclusion area specified, detect a flame event in the detection area outside of the at least one exclusion area are carried out for the IR flame camera.

15. A detector system in accordance with claim 13, wherein a radiation detection area of the radiation detector and a camera detection area of the at least one camera detector have a congruent or at least essentially congruent configuration, the at least one exclusion area comprising a predetermined flame event.

16. A detector system in accordance with claim 13, wherein:

the radiation detector is configured as an IR detector; or the at least one camera detector is configured as a VIS flame camera or as an IR flame camera; or the radiation detector is configured as an IR detector and the at least one camera detector is configured as a VIS flame camera or as an IR flame camera.

17. A detector system in accordance with claim 13, wherein the analysis and control unit is configured, if no radiation event is recognized with the analysis of the radiation detector, to: carry out a first analysis of the at least one camera detector for the recognition of a camera indication;

in case of a presence of the camera indication carry out of a second analysis of the at least one camera detector for a recognition of a camera event;

in case of a presence of a camera event, carry out a check as to whether the camera event is located outside of the at least one exclusion area specified; and upon determining the camera event is located outside of the at least one exclusion area specified, detect a flame event in the detection area outside of the at least one exclusion area.

18. A detector system in accordance with claim 13, wherein the analysis and control unit is configured to send an alarm signal if a flame event is detected in the detection area outside of the at least one exclusion area.

19. A detector system in accordance with claim 13, wherein the analysis and control unit is configured to continuously or at least essentially continuously:

analyze the radiation detector for a recognition of a radiation event;

upon the recognition of a radiation event, carry out of a first analysis of the at least one camera detector for a recognition of a camera indication;

upon the recognition of a camera indication, carry out a check as to whether the camera indication is located outside of the at least one exclusion area; and upon the check indicating the camera indication is located outside of the at least one exclusion area, detect a flame event in the detection area outside of the at least one exclusion area.

20. A detector system in accordance with claim 13, wherein:

at least two camera detectors are used comprising a VIS flame camera is used as a first camera detector and an IR flame camera is used as a second camera detector; and the analysis and control unit carries out the first analysis of the at least one camera detector for a recognition of a camera indication with the first camera detector; and in case of the absence of a camera indication of the first camera detector the analysis and control unit carries out a further first analysis of the at least one camera detector for a recognition of a camera indication with the second camera detector.

* * * * *